US010076194B2

(12) United States Patent
Wikner et al.

(10) Patent No.: US 10,076,194 B2
(45) Date of Patent: Sep. 18, 2018

(54) BABY CARRIER

(71) Applicant: BabyBjorn AB, Solna (SE)

(72) Inventors: Jakob Wikner, Taby (SE); Lisen Elmberg, Stockholm (SE); Elisabeth Ramel-Wahrberg, Taby (SE); Ulrika Vejbrink, Hagersten (SE); Marten Andren, Spanga (SE)

(73) Assignee: BABYBJORN AB, Solna (SE)

( * ) Notice: Subject to any disclaimer, the term of this patent is extended or adjusted under 35 U.S.C. 154(b) by 372 days.

(21) Appl. No.: 15/023,885

(22) PCT Filed: Oct. 7, 2014

(86) PCT No.: PCT/SE2014/051171

§ 371 (c)(1),
(2) Date: Mar. 22, 2016

(87) PCT Pub. No.: WO2015/053696

PCT Pub. Date: Apr. 16, 2015

(65) Prior Publication Data

US 2016/0227940 A1 Aug. 11, 2016

(30) Foreign Application Priority Data

Oct. 7, 2013 (SE) ..... 1351182

(51) Int. Cl.
*A47D 13/00* (2006.01)
*A47D 13/02* (2006.01)

(52) U.S. Cl.
CPC ..... *A47D 13/025* (2013.01)

(58) Field of Classification Search
CPC ..... A47D 13/025; A41D 2400/482
(Continued)

(56) References Cited

U.S. PATENT DOCUMENTS 4,986,458 A * 1/1991 Linday ..... A47D 13/025 224/160
5,246,152 A * 9/1993 Dotseth ..... A47D 13/025 224/158

(Continued)

FOREIGN PATENT DOCUMENTS

EP 2491825 8/2012

*Primary Examiner* — Peter Helvey
(74) *Attorney, Agent, or Firm* — Jacobson Holman, PLLC

(57) ABSTRACT

The invention relates to a baby carrier comprising chest straps, a waist belt, and a carrier bag mounted on the chest straps and the waist belt. Said carrier bag comprises a front piece having leg openings, and the front piece forms together with at least a portion of a means a carrier pouch. A lower portion of the front piece forms a first seat support. A second seat support is fixedly arranged at an inside of the lower portion of the front piece between said lower portion and said means. The second seat support is divisible by a partition means so as to enable deactivation said second seat support, and said partition means being arranged in the width direction of the front piece. The second seat support has a seat width which is narrower than the seat width of the first seat support. The front piece is provided at respective leg opening with a side edge which is flexible and/or openable and which permit a narrower leg position of a child when supported by the second seat support.

16 Claims, 9 Drawing Sheets

Figure 1:
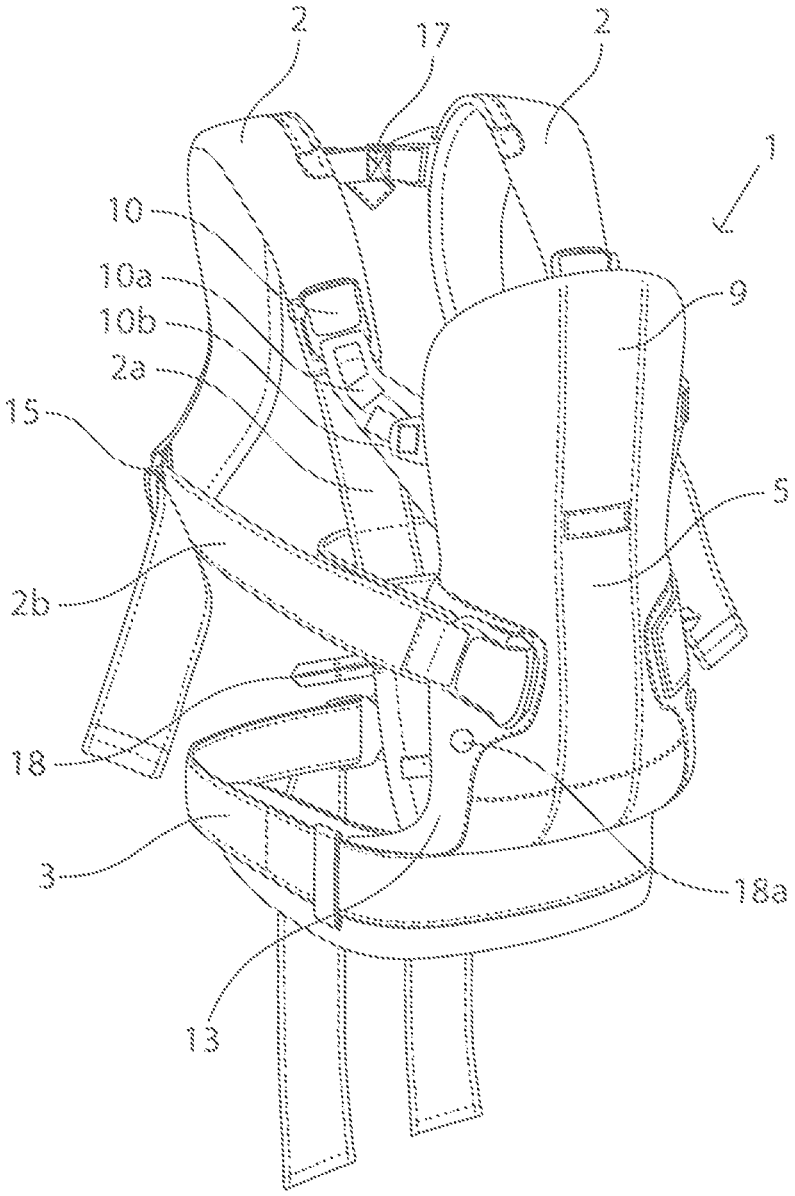

(58) Field of Classification Search
USPC ..... 224/158–161, 637, 643, 662
See application file for complete search history.

(56) References Cited

U.S. PATENT DOCUMENTS 5,361,952 A * 11/1994 Gold ..... A47D 13/025 224/159
D357,800 S * 5/1995 Roan ..... D3/213
5,490,620 A * 2/1996 Bergqvist ..... A47D 13/025 224/160
5,678,739 A * 10/1997 Darling ..... A47D 13/025 224/158
5,772,088 A * 6/1998 Nelson ..... A47D 13/025 224/158
5,813,580 A * 9/1998 Fair ..... A47D 13/025 224/160
5,934,528 A * 8/1999 Higuchi ..... A47D 13/025 224/159
6,520,391 B2 * 2/2003 Yen ..... A47D 13/02 224/160
6,598,771 B2 * 7/2003 Norman ..... A47D 13/025 224/160
D507,869 S * 8/2005 Liistro ..... D3/213
7,070,076 B2 * 7/2006 Bergkvist ..... A47D 13/025 224/160
7,168,600 B2 * 1/2007 Hwang ..... A47D 13/025 224/153
7,484,645 B2 * 2/2009 Hoff ..... A47D 13/025 224/159
D693,569 S * 11/2013 Lehan ..... D3/214
8,579,168 B2 * 11/2013 Zack ..... A47D 13/025 2/49.1
8,590,757 B2 * 11/2013 Frost ..... A47D 13/025 224/159
9,179,758 B2 * 11/2015 Calilung ..... A47D 13/025
9,185,993 B2 * 11/2015 Telford ..... A47D 13/025
9,241,582 B2 * 1/2016 Gilboa ..... A47D 13/025
2005/0155996 A1 * 7/2005 Hiscocks ..... A47D 13/025 224/160
2005/0242136 A1 * 11/2005 Moriguchi ..... A47D 13/025 224/160
2006/0113337 A1 * 6/2006 Yoshie ..... A45F 4/02 224/159
2007/0029356 A1 2/2007 Moriguchi et al.
2008/0283559 A1 11/2008 Parness et al.

* cited by examiner

BABY CARRIER

FIELD OF THE INVENTION

The present invention relates to a baby carrier of the type set out in the preamble of claim 1.

BACKGROUND OF THE INVENTION

Thus, the invention relates to a baby carrier of a type which includes a harness of the general type comprising chest straps, a waist belt, and a carrier pouch mounted on the harness and the waist belt, the carrier pouch being formed of a front piece provided with leg openings and at least parts of the chest straps or similar means.

The baby carrier according to the invention is preferably intended to carry a baby the face of which is directed to the wearer of the baby carrier, i.e. in face-to-face position.

It would be desirable to be able to use one and the same baby carrier during a longer period of time. However, one problem is that the baby will grow relatively much during the first year of its life, which results in that the seat height for the baby in the carrier must be able to be adjusted, preferably in a simple and safe way, i.e. between a baby position and a child position.

Usually, this is done by a lower portion of the front piece, which forms a seat support, is shaped as a tongue which can be shortened or extended by a suitable buckle depending upon the seat height desired.

However, this results in that the seat support is relatively narrow and is not suitable for larger/heavier children and that the seat height may possibly be changed without the wearer of the baby carrier is aware of this.

One way of avoiding this problem with a relatively narrow seat support is to attach the lower part of the front piece to the waist belt so as to obtain a relatively wide seat support. However, this results in that the possibility to adjust the seat height of the child is lost.

In another type of baby carrier it is possible to adjust the seat height of the child by mounting a so called baby insert to the harness so as to be able to use the baby carrier for an extended period of time. A drawback with such a baby carrier is that the baby insert is loose part and may thereby be lost.

US 2007/0029356 A1 discloses a baby carrier in which it is possible to adjust the seat height of a child in the baby carrier. This baby carrier comprises a carrier bag. The carrier bag is however detachably attached to the harness, and the seat height can be adjusted by a lower supporting portion of the carrier bag being either detachably attached at different heights on the harness or provided with straps, the length of which can be adjusted so as to adjust the seat height of the baby carrier. See particularly FIGS. 29A and 32D with accompanying text.

It should be noted that in both of the above-mentioned embodiments the lower portion of the carrier bag is detachably attached to the harness, which may result in that, if the detachable attachment is opened, a child carried by the baby carrier will fall out of the baby carrier.

A further drawback of the baby carrier according to US 2007/0029356 A1 is that the carrier bag is too short when the lower supporting portion is positioned in the upper position of the harness.

Yet a further drawback of the baby carrier according to US 2007/0029356 A1 is that width of the seat support is only modified to a limit extent when the height of the lower supporting portion of the carrier bag is adjusted.

SUMMARY OF THE INVENTION

An object of the invention is thus to achieve a baby carrier with for a child adjustable seat height and which baby carrier can be used for a longer period of time, it also provide the possibility to support smaller/lighter and larger/heavier children.

A further object of the invention is to avoid user mistakes, i.e. the adjustment of the seat height of the child in the baby carrier should be as simple as possible and it should be simple to see the seat height set, and the baby carrier does not contain any loose parts that may be lost. The child should not by mistake be able to fall out of the baby carrier.

These objects are achieved according to the invention by a baby carrier comprising chest straps, which are arrange to extend around both shoulder regions of a wearer, a waist belt, and a carrier bag mounted on the chest straps and the waist belt, said carrier bag comprises a front piece having leg openings, said front piece forms together with at least a portion of a means a carrier pouch, wherein a lower portion of the front piece forms a first seat support , and the front piece is at an upper portion detachably attached to respective chest strap by a buckle, characterized in that a second seat support is arranged at an inside of the lower portion of the front piece between said lower portion and said means, that the second seat support is divisible by a partition means so as to enable deactivation said second seat support, said partition means being arranged in the width direction of the front piece, that the second seat support has a seat width which is narrower than the seat width of the first seat support, and that the front piece is provided at respective leg opening with a side edge which is flexible and/or openable and which permit a narrower leg position of a child when supported by the second seat support.

Further embodiments of the baby carrier according to the invention are set forth in the depending claims.

SHORT DESCRIPTION OF THE DRAWINGS

Figure 2:
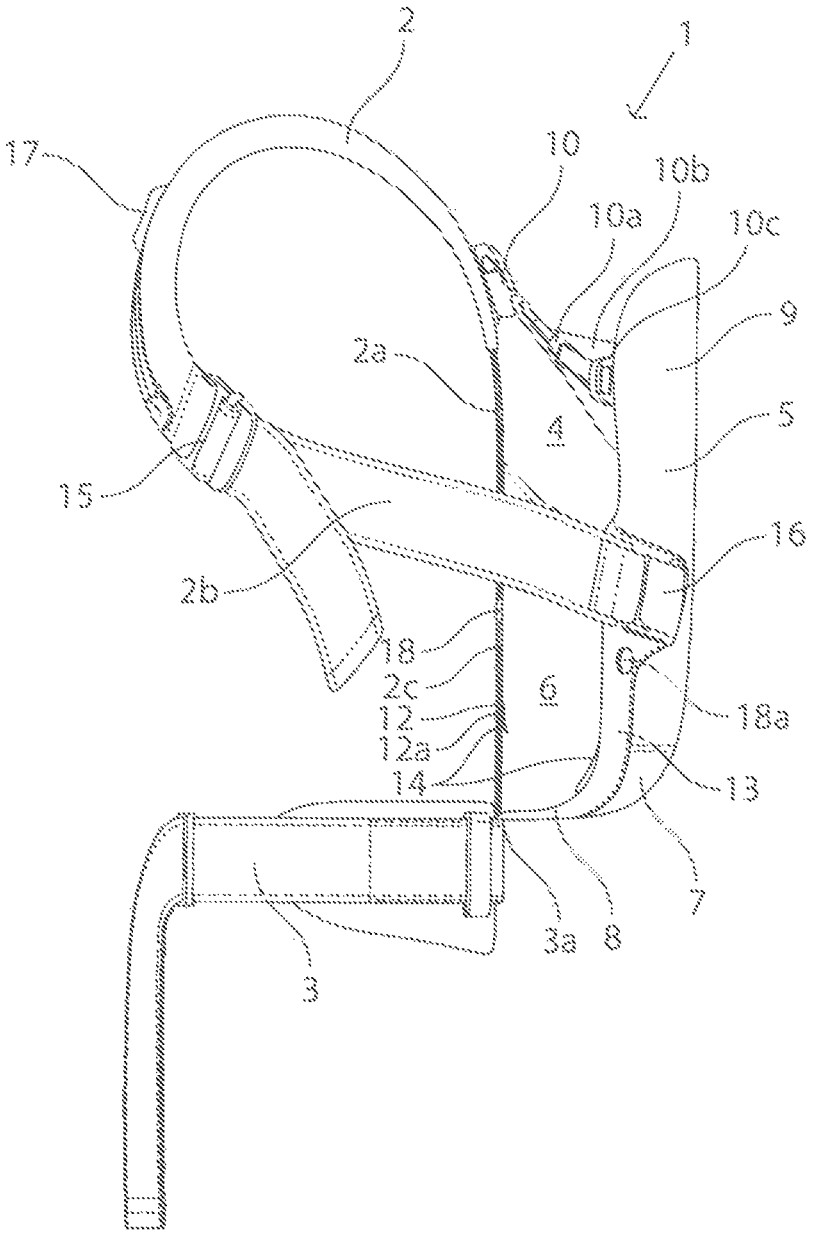
Figure 3:
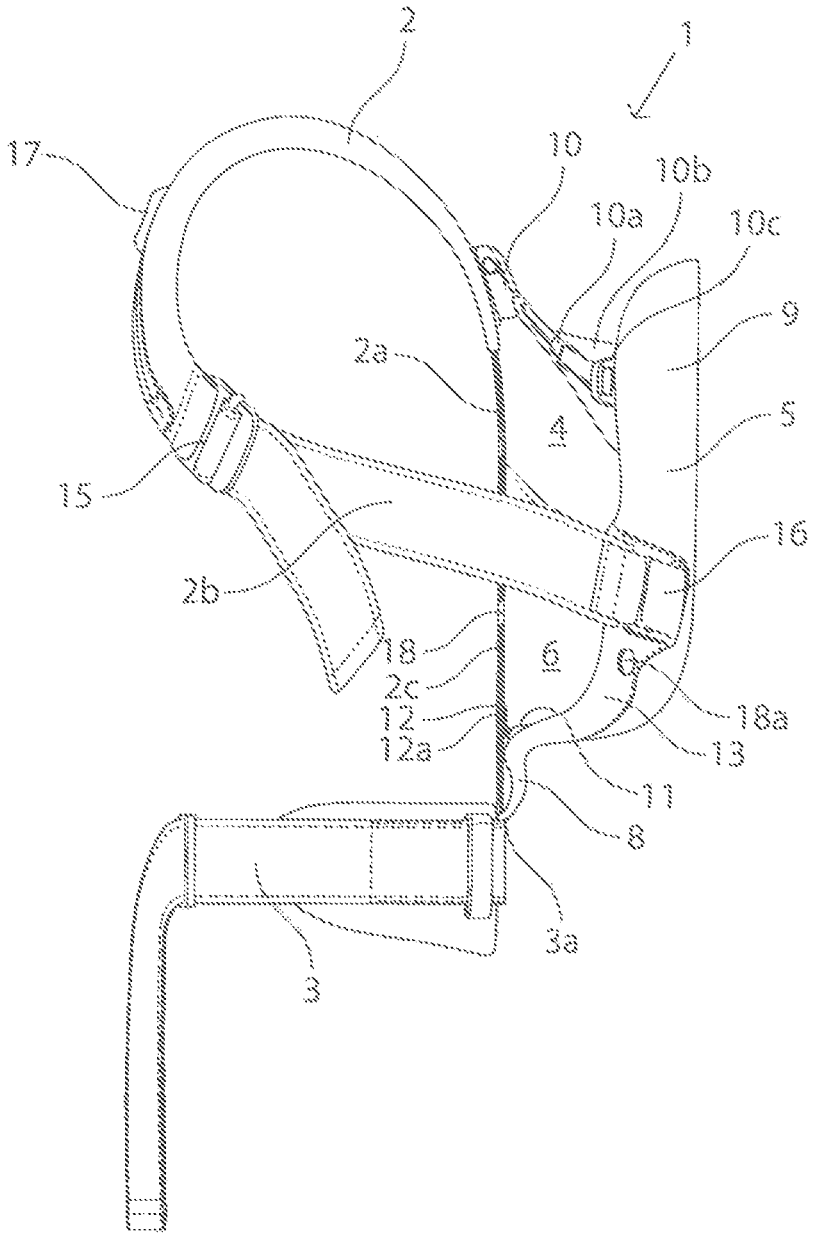
Figure 4:
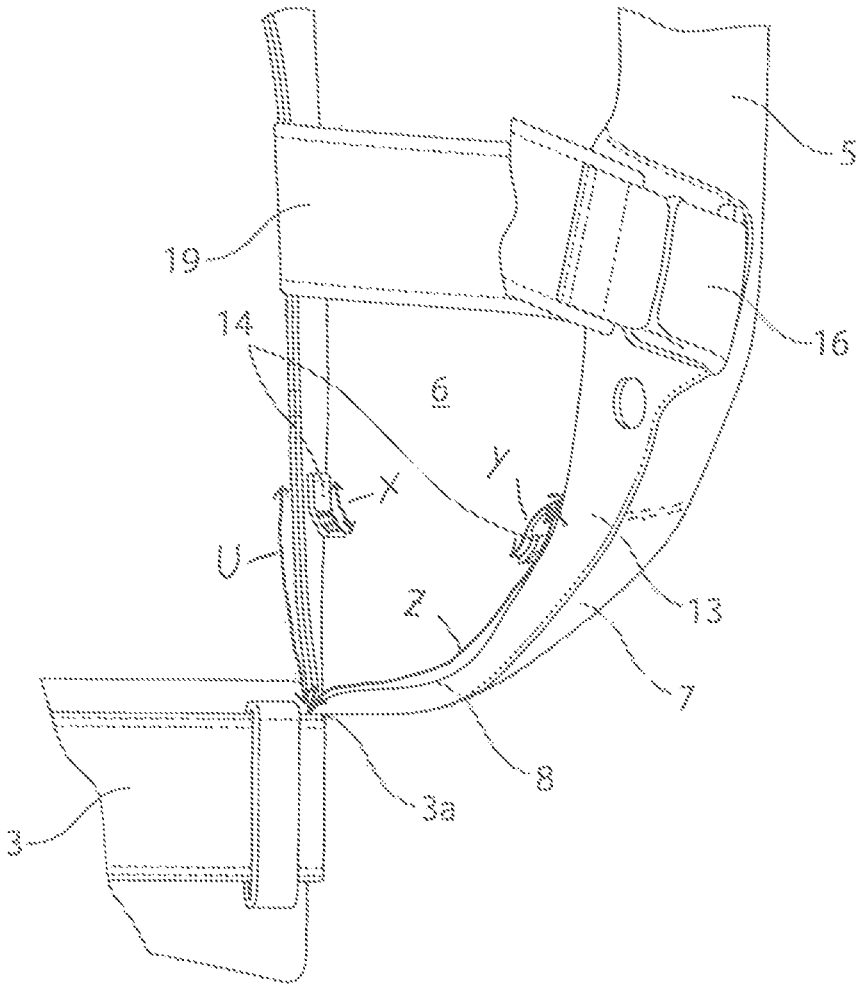
Figure 5:
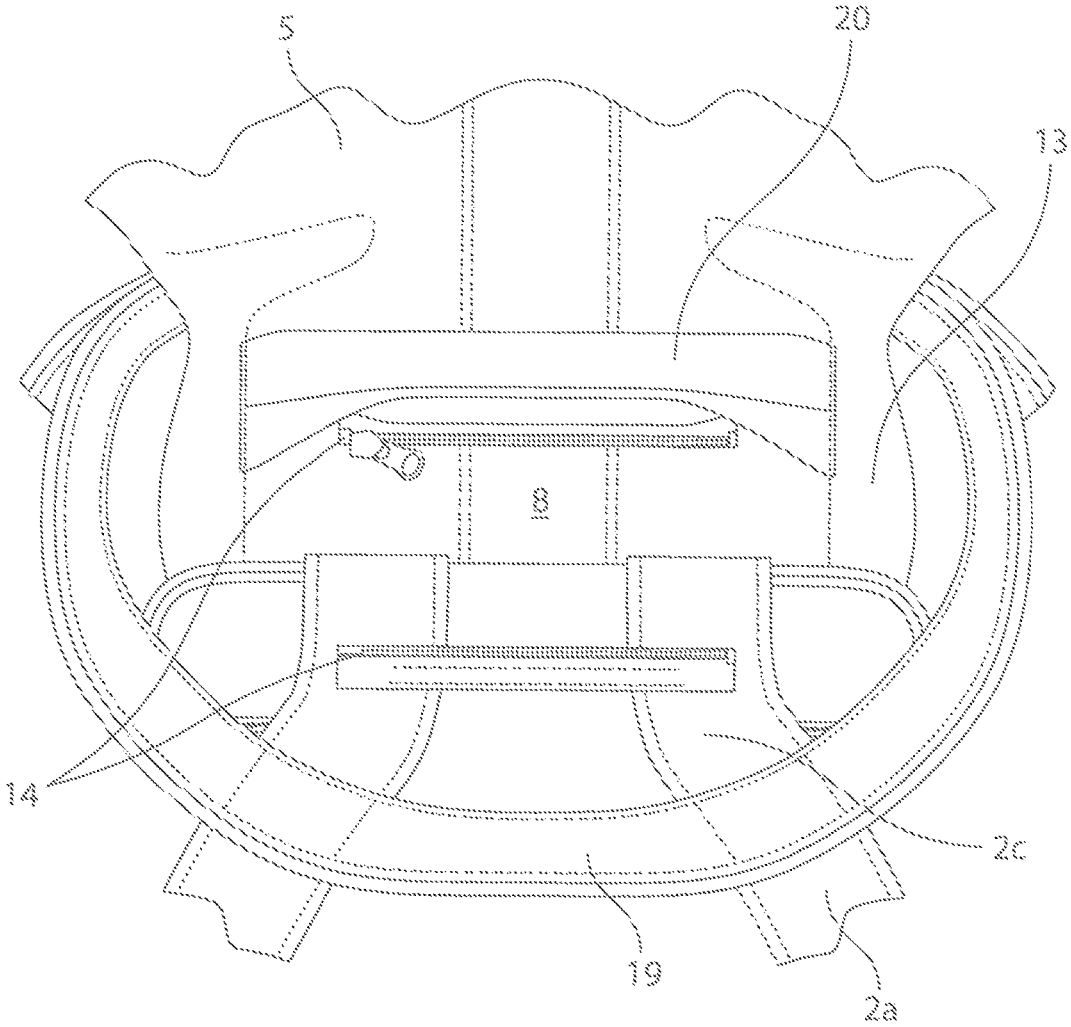
Figure 6:
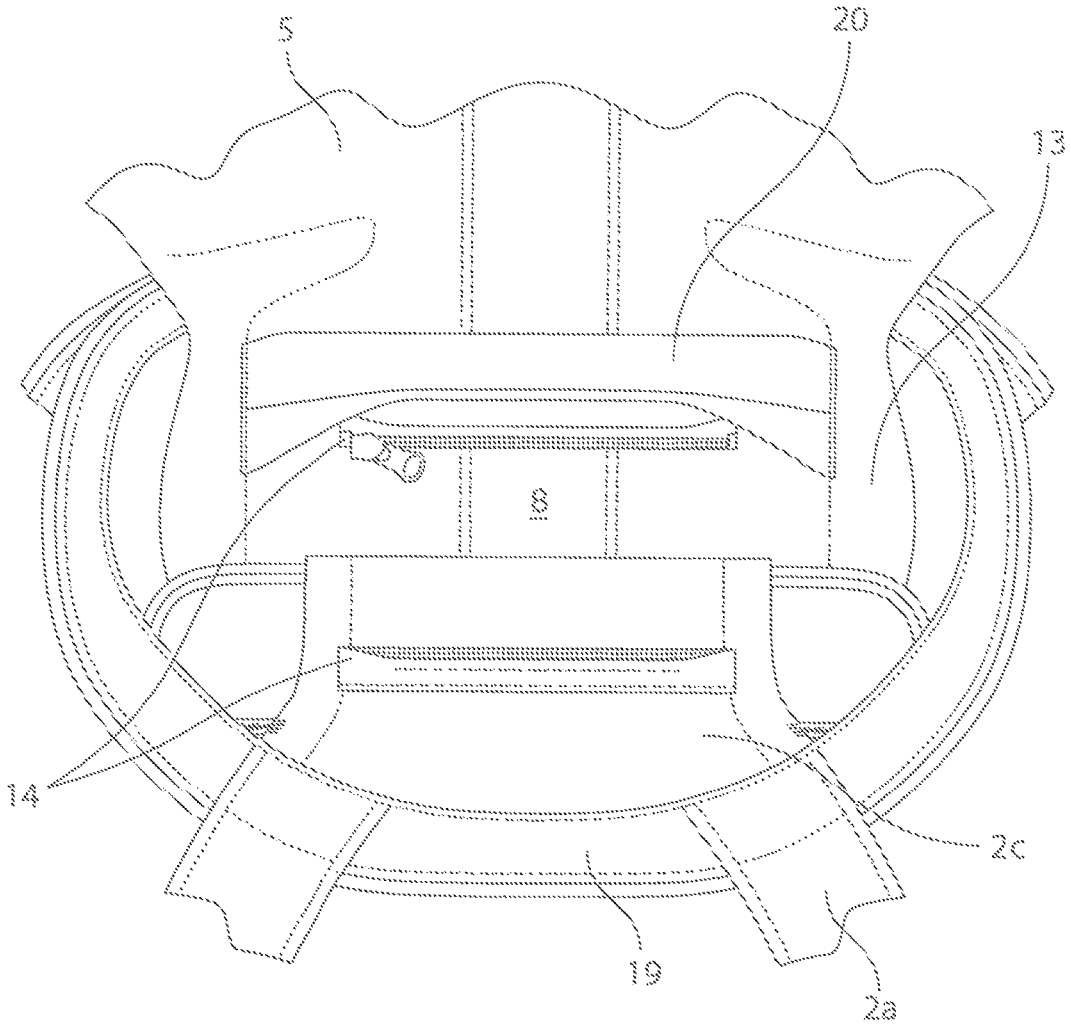
Figure 7:
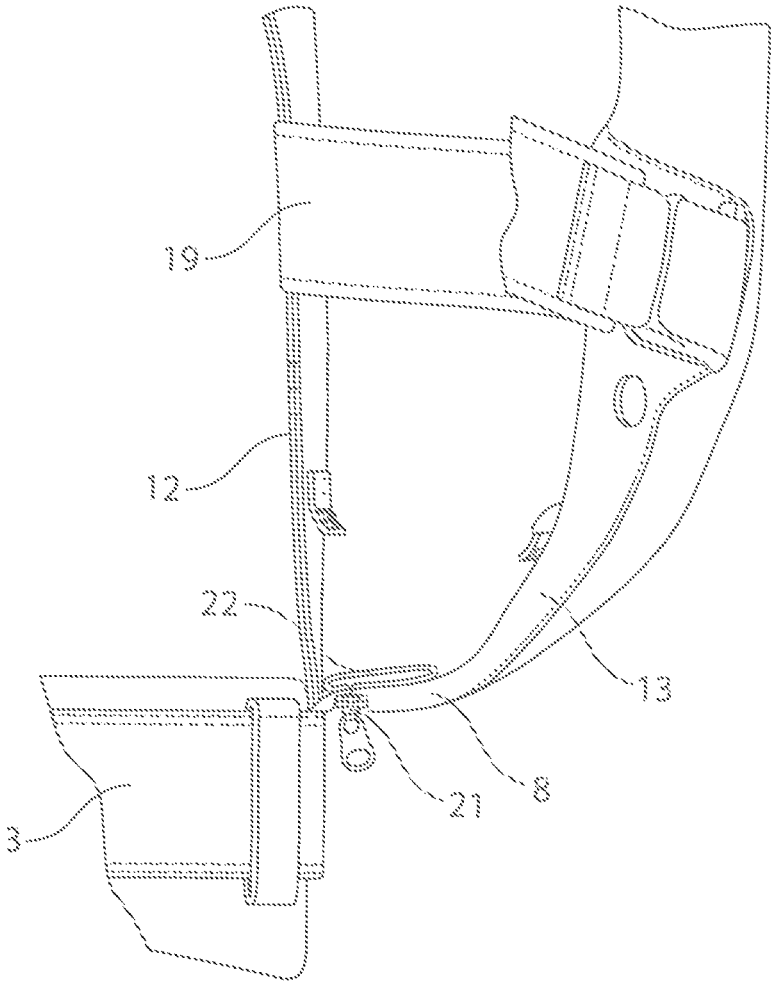
Figure 8:
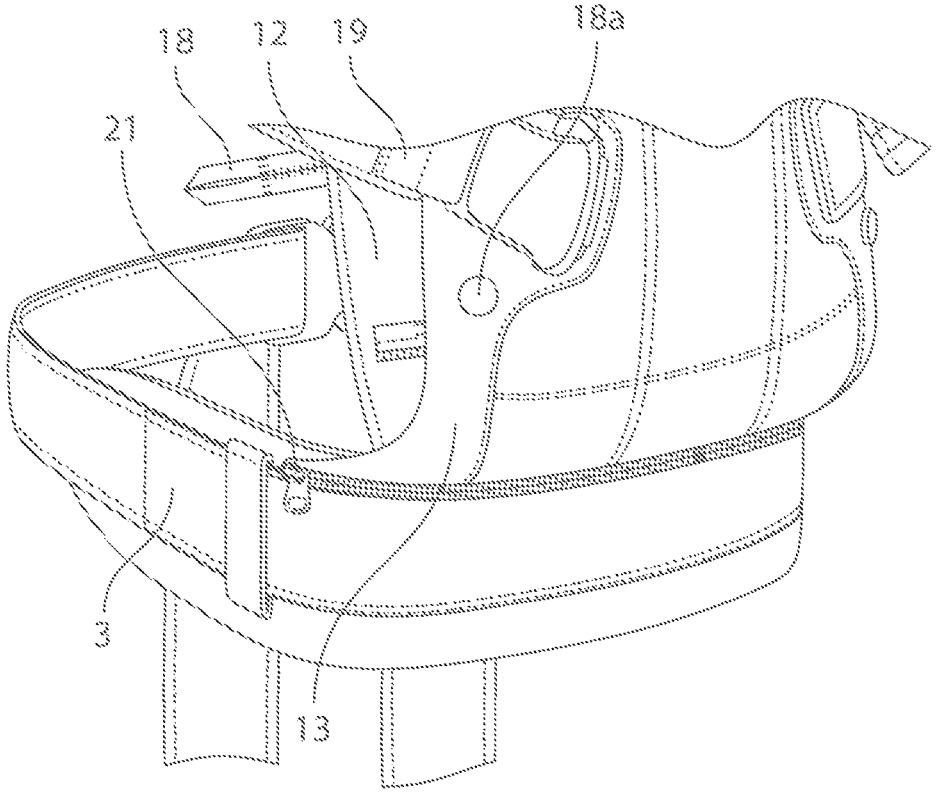
Figure 9:
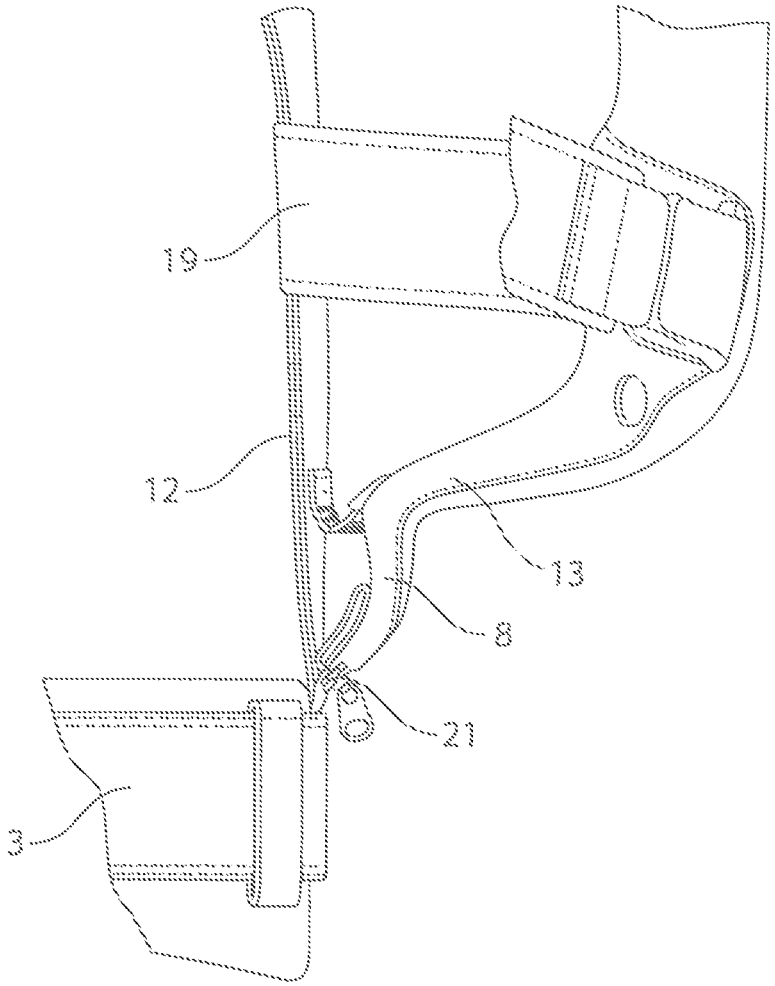

The invention will now be described in more detail in the form of a non-limiting example with reference to the accompanying drawings, in which FIG. 1 is a view obliquely from the front of a first embodiment of a baby carrier according to the invention, FIG. 2 is a side view of the baby carrier according to the first embodiment of the invention with a second seat support non-activated, FIG. 3 illustrates the same side view as in FIG. 2 but with the second seat support activated, FIG. 4 is an enlarged partial side view of a portion of the baby carrier shown in FIG. 2, FIG. 5 is an enlarged partial view from above of the baby carrier shown in FIG. 1 with the second seat support non-activated, FIG. 6 is a view similar to the one in FIG. 5 of a second embodiment of the baby carrier according to the invention with a lower portion of chest straps close to the waist belt formed in one piece, FIG. 7 is a view similar to the one in FIG. 4 of a third embodiment of the baby carrier according to the invention having a zip fastener shown in closed position at a lower portion of the front piece, FIG. 8 is an enlarged partial view obliquely from the front of the embodiment of the baby carrier shown in FIG. 7, and FIG. 9 is a view similar to the one in FIG. 7 with the zip fastener shown in closed position at the lower portion of the front piece and with the second seat support activated.

DETAILED DESCRIPTION OF PREFERRED EMBODIMENTS

FIG. 1 shows a baby carrier 1 according to the invention which comprises adjustable chest straps 2 arranged to extend around both shoulder regions of a wearer, an adjustable waist belt 3, and a carrier bag 4 mounted on the chest straps and the waist belt. The carrier bag comprises a front piece 5 provided with leg openings, a end of a lower portion 7 of the front piece 5 being fixedly attached to the waist belt 3 and forms together with at least a portion of the chest straps 2 or similar means 12 a carrier pouch 6.

In a preferred embodiment, the front piece 5 is made of a suitable fabric, and padding is enclosed by the fabric. In another embodiment the baby carrier can be made of a so called mesh fabric, wherein a mesh fabric being defined as a loosely woven or knitted fabric having a large number of closely spaced holes.

As can be seen particularly from FIGS. 2 and 3, each chest strap 2 comprises a first part 2*a,* which extends in the first embodiment from the waist belt 3 to a buckle 15, and a second part 2*b,* which extends from said buckle 15 to the side of the front piece 5.

Moreover, at least one of the second parts 2*b* is detachably connected to said side of the front piece 5 by a connecting device 16.

The end of a lower portion 7 of the front piece is connected to the waist belt 3, preferably to an upper border 3*a* of the waist belt, and forms a first seat support 8. The end of the lower portion 7 of the front piece 5 is, in a preferred embodiment, fixedly attached to the upper border 3*a* of the waist belt 3 and more particularly is attached by sewing said end to said upper border 3*a* of the waist belt 3, i.e. the first seat support 8 is a fixed seat support.

From FIGS. 2 and 3 it can be inferred that the front piece 5 is, at an upper portion 9, which forms a head support, detachably connected to respective chest strap 2 by a detachably buckle 10 arranged at an end of an elongated piece of fabric 10*b,* the other end of which has a broad attachment part to said upper portion 9 of said front piece 5 so as to distribute the load and to avoid that the upper portion 9 is folded downwardly. At the outside of the piece of fabric 10*b* a strap 10*a,* adjustable in the longitudinal direction, is arranged so as to make possible a shortening of the length of said piece of fabric. One end of the strap 10*a,* preferably the end which is located at the detachable buckle 10, is fixedly attached to the piece of fabric, and the other end is adjustably attached to a bucket 10*c,* which is preferably attached to the border of the upper portion 9 of said front piece 5. By attaching the bucket 10*c* in this way it is achieved that the load, carried by the strap, is distributed over the upper portion 9, and that a shortening of said strap can be done without any major fold(s) is (are) formed at the piece of fabric. The upper portion 9 of the front piece 5 is in a central area of the same provided with a stiff but yet flexible sheet, which extends from an imaginary line between respective lower points of attachment of the buckle 10*c* and an upper border of the upper portion 9 of the front piece 5.

A second seat support 11, see particularly FIGS. 3 and 9, is fixedly arranged at the inside of the lower portion 7 of the front piece 5, and more particularly between the lower portion 7 of the front piece 5 and a means 12, preferably a lower portion 12*a* of said means, which means 12 is in the first embodiment formed of a lower portion of the first part 2*a* of respective chest strap 2, see FIG. 5, for instance, one end of the first part 2*a* being fixedly attached to the upper border 3*a* of the waist belt 3, or in the second embodiment of a part 2*c* formed in one piece, see FIG. 6, which part extends between the upper border 3*a* of the waist belt 3 and an essentially horizontal strap 19. Thus, a lower portion of said part 2*c* is attached to the upper border 3*a* of said waist belt 3, and an upper portion of said part 2*c* is attached to either to a lower border of said strap 19 or a lower end of respective first part 2*a*.

The second seat support 11 has a seat width which is narrower than the seat width of the first seat support 8.

The second seat support 11 is preferably formed of a piece of fabric with suitable depth and width. The piece of fabric is preferably attached by sewing to on one hand the lower portion 7 of the front piece 5 and on the other hand to a lower portion of the means 12, i.e. either a lower portion 12*a* of respective chest strap 2 or the part 2*c* formed in one piece. The second seat support 11 is divisible into two pieces by a partition means 14 arranged in the width direction of the front piece 5. See FIG. 4, for instance. The partition means 14 is preferably selected from the group consisting of zip fastener, Velcro©, hooks and eyes, fittings of plastic material or metal, buttons and lacing and is used for activation or inactivation of the second seat support. In the activated condition of the second seat support it is achieved that a child carried by the baby carrier will be sitting higher up in the carrier bag 4, and is preferably used when carrying a relatively small child or baby, i.e. in a baby position of the baby carrier.

In a preferred embodiment the lower portion 12*c* of respective chest strap 2 or the part 2*c* formed in one piece and the lower portion 7 of the front piece 5 are fixedly attached, sewed, at the same location to the upper border 3*a* of the waist belt 3. See FIG. 4, for instance.

As can be seen particularly from FIGS. 4 to 6 the depth (distance X+Y in FIG. 4) of the second seat support can be made relatively narrow, which results in that it, in its inactivated state, will not interfere with a child carried by the first seat support in the baby carrier, and it can be adapted to support a small child or baby. The one or the other part or both parts of the second seat support and/or the partition means 14 can be covered by a means 20, a tongue of fabric 20, for instance, which in the activated state of the second seat support wholly or partly covers the second seat support. The partition means 14 of the second seat support 11 may have a signal colour so that a wearer of baby carrier may in a simple way to see if the second seat support is activated or not.

In the case the partition means 14 is a zip fastener, the zip fastener is, in a preferred embodiment, not sewed on all the way to the top stop, i.e. where the slider is situated in the closed position of the zip fastener. The reason for this is to avoid the zip fastener from being opened when it is loaded, i.e. when a child is supported by the second seat support.

Leg openings having flexible side edges 13 are formed at the lower/bottom portion of the front piece 5, see FIGS. 2-6, and in one embodiment are made only of a fabric, i.e. lacks padding. The fabric of the side edges 13 may be of the same type as the rest of the front piece 5 or may be of a different type so as to increase the comfort of the child. The fabric of the side edges may preferably be made flexible by orientating the main direction of the fabric in an angle of about 45° relative to the main direction of the fabric of the front piece 5.

The respective side edge 13 is preferably sewed to the edge portion of the front piece 5 in such a way that the side edge will have a width of at least 1 cm, preferably at least 2 cm, measured normal to a stitch line for sewing on the side edge to the front piece.

At least a lower portion of respective side edge 13 of the front piece 5 is, when the second seat support 11 is activated, so designed, in one embodiment, that a surplus of fabric is formed at said side edge 13, which increase the comfort of the child, i.e. the side edges will not form a pressure on the child's thighs. See particular FIG. 3.

As can be inferred from FIG. 4 the depth X+Y of the second seat support 11 between its point of attachment to the means 12 and its point of attachment (shown in FIG. 4 as the stitch line) to the lower portion 7 of the front piece 5 is shorter than a distance Z between the point of attachment for the second seat support 11 to the lower portion 7 of the front piece 5 and the point of attachment for the first seat support 8 to the upper border 3*a* of the waist belt 3. This depth X+Y is about 40 to 80 mm, preferably about 50 to 70 mm, and most preferably about 60 mm, and the distance z is about 75 to 115 mm, preferably 85 to 105 mm, and most preferably about 95 mm. Moreover, a distance U between the point of attachment of the second seat support 11 to the means 12 and the point of attachment of the means 12 to the upper border 3*a* of the waist belt 3 should be about 30 to 120 mm, preferably about 50 to 100 mm, and most preferably about 70 mm.

In the embodiment shown in FIG. 4, in which the second seat support 11 is in the form of a zip fastener, the part of the zip fastener, which is attached to the means 12, has preferably a width X in the depth direction of about 10 to 25 mm, preferably about 15 mm, and the other part of the zip fastener, which is attached to the lower portion 7 of the front piece 5, has a width Y in the depth direction of about 30 to 55 mm, preferably about 45 mm.

In a third embodiment, shown in FIGS. 7-9, at least respective side edge 13, preferably at its lowest point, be provided with a zip fastener 21 or any other suitable means so as to, in the open state of the respective zip fastener, reduce the width of the lower portion 7 of the front piece 5, i.e. the width of the first seat support 8, when the second seat support 11 is activated. By providing respective side edge 13 with a zip fastener 21 or any other suitable means results in that the side edge 13 does not need to be flexible, since instead the respective side edge 13 can be opened. In a preferred embodiment the zip fastener 21 extends to at least the double vertical stitch line of the front piece shown in FIG. 8 and is, towards the inside of the carrier pouch 6, covered by a triangular piece of fabric 22 which, in the open position of the zip fastener 21, connects the two parts of the zip fastener.

To be able to reduce the size of respective leg opening formed at the lower portion of the front piece 5 a strap 18 with associated button 18*a* is arranged. See FIG. 1.

To prevent a child from falling out of the carrier pouch 6 the essentially horizontal strap 19 is arranged to extend between and at the level of point of attachment for respective second part 2*b* of the chest straps 2 to the front piece 5 so that a closed loop is formed by the strap 19 together with the relevant portion front piece 5. See particularly FIGS. 5-9. This strap 19 is preferably also attached to respective part 2*a* of the chest straps 2 or the part 2*c* formed in one piece so as to, together with the first seat support 8 or the second seat support 11, make a secure enclosing of the child supported by the inventive baby carrier.

The expression that the chest straps 2 are arranged to extend around both shoulder regions of a wearer should be understood to include that the chest straps can either be crossed or extend in parallel relative to each other on the back side/chest side of the wearer, wherein in both cases the chest straps are connected to each other with a buckle 17 which is movable along said chest straps and possibly also makes possible adjustment of the distance between said chest straps.

The invention claimed is:

1. A baby carrier (1) comprising chest straps (2), which are arrange to extend around both shoulder regions of a wearer, a waist belt (3), and a carrier bag (4) mounted on the chest straps and the waist belt, said carrier be (4) comprises a front piece (5) having leg openings said front piece (5) forms together with at least a portion of a means (12) a carrier pouch (6), wherein a lower portion (7) of the front piece (5) forms a first seat support (8), and the front piece (5) is at an upper portion (9) detachably attached to respective chest strap (2) by a buckle (10), characterized in that a second seat support (11) is fixedly arranged at an inside of the lower portion (7) of the front piece (5) between said lower portion (7) and said means (12), that the second seat support (11) is divisible by a partition means (14) so as to enable deactivation said second seat support (11), said partition means (14) being arranged in the width direction of the front piece, that the second seat support (11) has a seat width which is narrower than the seat width of the first seat support (8), and that the front piece (5) is provided at respective leg opening with a side edge (13) which is flexible and/or openable and which permit a narrower leg position of a child when supported by the second seat support (11).

2. The baby carrier according to claim 1, characterized in that the lower portion (7) of the front piece (5) is fixedly attached to an upper border (3*a*) of the waist belt (3).

3. The baby carrier according to claim 1, characterized in that the second seat support (11) is arranged between the lower portion (7) of the front piece (5) an a lower portion (12*a*) of the means (12), and that the means (12) is formed of a portion of a first part (2*a*) of respective chest strap (2), one end of said first part being fixedly attached to the waist belt (3).

4. The baby carrier according to claim 1, characterized in that the second seat support (11) is arranged between the lower portion (7) of the front piece (5) and a lower portion (12*a*) of the means 12, and that the means (12) is formed of a part (2*c*) formed in one piece, one end of said part (2*c*)being fixedly attached to the waist belt (3) and the other end of which being fixedly attached to a first part (2*a*) of respective chest strap (2).

5. The baby carrier according to claim 1, characterized in that the partition means (14) is selected from the group consisting of zip fastener, Velcro©-fastener, hooks and eyes, fittings of plastic material or metal, buttons, and lacing.

6. The baby carrier according to claim 1, characterized in that the partition means (14) is at least partially covered by a means (20).

7. The baby carrier according to claim 1, characterized in that the partition means (14) has a signal colour.

8. The baby carrier according to claim 1, characterized in that respective chest strap (2) comprises a first part (2*a*), which extends from the waist belt (3) to a buckle (15) of respective chest strap (2), and a second part (2*b*), which extends from said buckle (15) to one side of the front piece (5).

9. The baby carrier according to claim 8, characterized in that at least one of said second parts (2*b*) is detachably attached to the side of the front piece (5) by a connecting device (16).

10. The baby carrier according to claim 1, characterized in that the chest straps (2) is connected to each other on the back side of the wearer by a buckle (17) which is displaceable along said chest straps.

11. The baby carrier according to claim 6, characterized in that the means (20) is, in the activated condition of the second seat support (2), arranged to wholly of partially cover said second seat support (11).

12. The baby carrier according to claim 2, characterized in that a depth (X+Y) of the second seat support (11) between its point of attachment to the means (12) respective its point of attachment to the lower portion (7) of the front piece (5) is shorter than a distance (Z) between a point of attachment of the second seat support (11) to the lower portion (7) of the front piece (5) and a point of attachment of the first seat support (8) to the upper border (3*a*) of the waist belt (3).

13. The baby carrier according to claim 12, characterized in that the depth (X+Y) is about 40 to 80 mm, preferably about 50 to 70 mm, and most preferably about 60 mm, and that the distance (Z) is about 75 to 115 mm, preferably about 85 to 105 mm, and most preferably about 95 mm.

14. The baby carrier according to claim 1, characterized in that at least respective side edge (13) of the first seat support (8) is provided with a zip fastener (21) so as to, in the open position of said zip fasteners, reduce the seat width of said first seat support (8).

15. The baby carrier according to claim 8, characterized in that it further comprises an essentially horizontal strap (19) arranged to extend between and at a level of point of attachment for respective second part (2*b*) of the chest straps (2) to the front piece (5) so as to form a closed loop together with the relevant portion front piece (5), and that said strap (19) is attached to respective part (2*a*) of the chest straps (2) or the part (2*c*) formed in one piece.

16. The baby carrier according to claim 1, characterized in that it is designed for carrying a baby with its face directed toward the wearer.

* * * * *